US005829220A

United States Patent [19]

Zumeta

[11] Patent Number: 5,829,220

[45] Date of Patent: Nov. 3, 1998

[54] WALL STRAIGHTENING DEVICE AND METHOD OF STRAIGHTENING

[76] Inventor: Roberto G. Zumeta, 11206 Ivyridge Rd., Houston, Tex. 77043

[21] Appl. No.: 848,245

[22] Filed: Apr. 29, 1997

Related U.S. Application Data

[63] Continuation-in-part of Ser. No. 589,858, Jan. 22, 1996, abandoned.

[51] Int. Cl.[6] ..... E02D 35/00

[52] U.S. Cl. ..... 52/741.13; 52/745.09; 52/749.1; 52/514; 254/133 R; 405/258

[58] Field of Search ..... 52/514, 741.11, 52/741.13, 741.14, 742.14, 745.09, 749.1; 254/131, 133 R; 405/258, 272, 284, 285

[56] References Cited

U.S. PATENT DOCUMENTS

| | | | |
|---|---|---|---|
| 377,940 | 2/1888 | Hevner | 52/514 X |
| 469,116 | 2/1892 | Botts | 254/131 |
| 1,325,963 | 12/1919 | Templeton | 254/133 R X |
| 4,083,156 | 4/1978 | Tye | 52/749.1 X |
| 4,304,394 | 12/1981 | O'Hara et al. | 254/133 R X |

*Primary Examiner*—Carl D. Friedman
*Assistant Examiner*—Kevin D. Wilkens
*Attorney, Agent, or Firm*—Robert W. B. Dickerson

[57] ABSTRACT

An angled member includes a rod portion, for exerting a force against a leaning wall, and a cross piece, linked to one end of the rod, against which cross piece an adjustable jack acts; the other end of the rod is linked, via a connector, to a pin which is insertable within the wall or the wall's foundation, preferably the foundation, the connector passing under the foundation to connect the pin and the angle rod; roller member movably positioned intermediate the angle rod and the foundation.

6 Claims, 1 Drawing Sheet

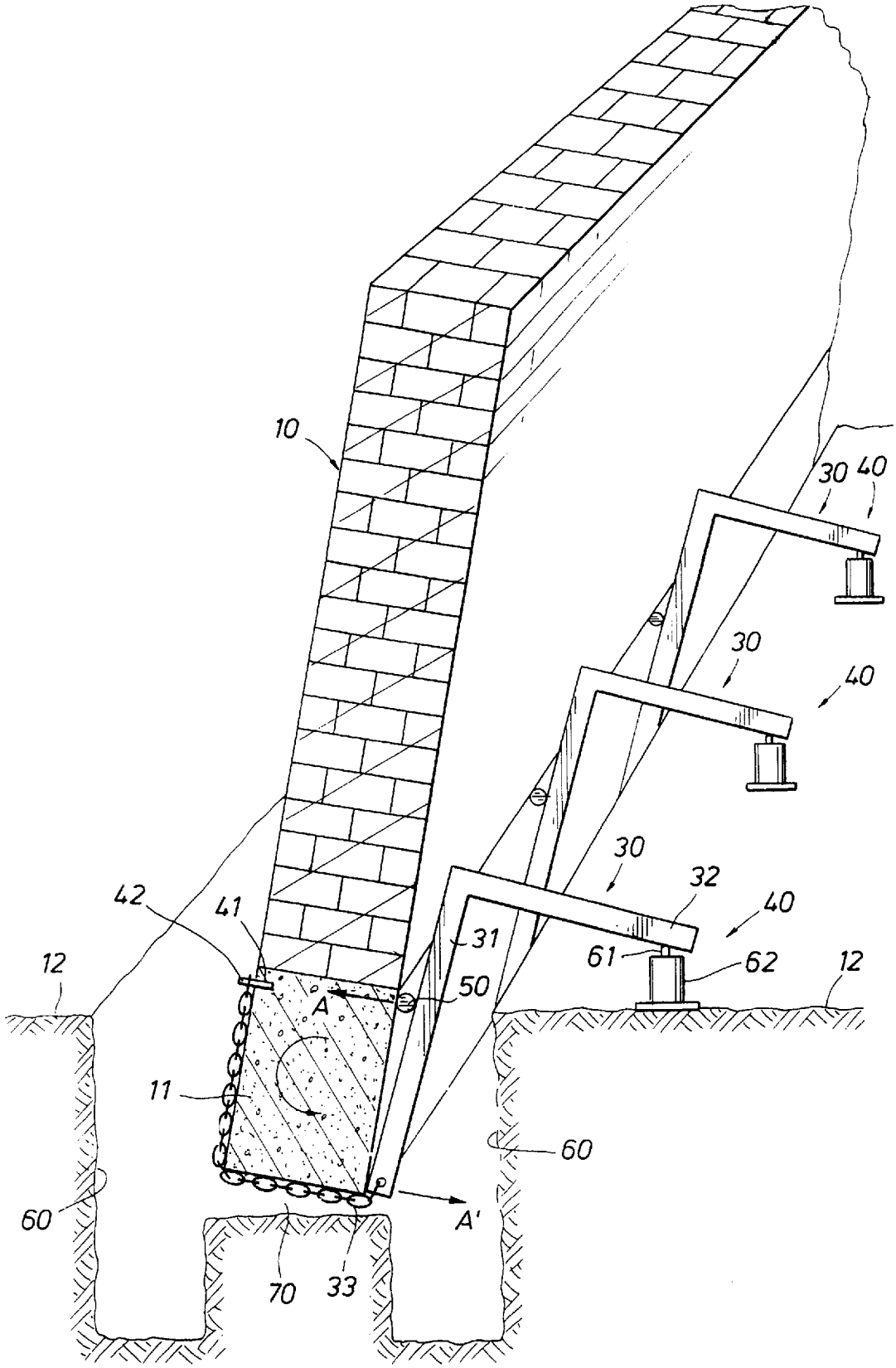
10
30
40
30
40
30
32
40
42
41
31
61
62
12
12
50
A
11
60
60
A'
70
33

WALL STRAIGHTENING DEVICE AND METHOD OF STRAIGHTENING

This is a CIP of Application 08/589,858, filed Jan. 22, 1996 now abandoned.

BACKGROUND OF THE INVENTION

Masonry walls normally are laid atop a foundation, and extend therealong. Such walls, when constructed outdoors to serve as fences or property dividers, usually extend in the range of 3 to 8 feet above the foundation. The foundation itself may be formed atop the ground surface or within a trench or depression formed therein. A change in soil condition oftentimes causes a shift in the position of the foundation, which shift is magnified in the wall extending thereabove. Such change in the position of the wall may well result in its cracking or in its destruction. Obviously means are needed to restore the wall's integrity prior to it having been damaged past the point of no return. This invention was developed to solve this very problem.

SUMMARY OF THE INVENTION

Masonry walls are generally laid atop a concrete foundation, the foundation first being formed, as by pouring, on or beneath the ground's surface. With the passage of time, and any resulting shifting of the sub-structure, the wall and its foundation will oftentimes lean or tilt. Without corrective action, the wall may well crack and be destroyed. Applicant causes a force to be applied against the wall or foundation preferably against the foundation, in a direction counter to that in which the wall is leaning, tending to return it toward its original position by rotating it, in essence. This force is actually a component of a force generated by a jack, or similar lifting device, upwardly urging a cross piece, which cross piece is secured to and depends from one end of a rod or strut. Said component of this force is normally exerted against the foundation by virtue of a roller which is movably positioned intermediate the strut and the foundation. The other end of the strut is linked by a connector, such as a chain, to a pin or bar, which, in turn, is linked preferably to the side of the foundation opposite to the strut. As the cross piece and strut combination is acted upon by the jack, the connector is linked to the pin and exerts a force against the mentioned foundation in a direction substantially opposite to that exerted by the jack against the foundation. The combination of the forces exerted against the foundation or wall by the strut through the roller and by connector, tend to rotate the foundation and wall toward their original position.

DESCRIPTION OF THE DRAWING

The FIGURE is a perspective of a portion of the wall, a vertical section having been taken at one of the jack locations.

DESCRIPTION OF A PREFERRED EMBODIMENT

Looking at the drawing, wall 10, which may be masonry, brick, stone, or the like, rests upon foundation 11. Such foundation, normally formed of concrete, would sit upon or be imbedded in a trench formed in the ground surface, such surface generally illustrated at 12.

Assume now that the wall 10 begins to sag and/or bend in a direction opposite to arrow "A", and possibly to crack. In order to restore the wall to its vertical position, a force in the direction of arrow "A", which is opposite to the tilt must be exerted. To produce this force, Applicant utilizes an angled member 30 which has a vertical rod or strut 31 and a cross piece 32 depending from one end (the top) of said strut. Linked to the other end (the bottom) of the strut is chain connector or cradle 33. Jack member 40 has a housing 62 and a rod or lift member 61 extendible therefrom. The housing of jack 40 may be positioned on the surface of the ground, or on a platform constructed therefor. Said jack's movable lift member 61 contacts the under surface of cross piece 32.

Pairs of opposed vertical holes 60 are dug on opposite sides of the foundation 11, extending beneath said foundation. Said opposed pair of holes is then connected by a tunnel 70 which extends beneath and approximately the width of the foundation. Note that only one pair of holes 60 is shown. Obviously there would be a plurality of such pairs of oppositely positioned holes, spaced along and extending substantially the length of the wall whose sag or tilt is being corrected. These holes 60, and the connecting tunnel 70, may be dug in many convenient manners, including by use of hand tools, shovels, power equipment including drills, high pressure water blast devices, or whatever is necessary to form an adequately sized passageway to accommodate strut 31 and connector 33. Each of the tunnels would be similarly formed, so as to connect their respective pair of holes 60, below foundation 11, so as to accommodate chain or connector 33. In order to determine the depth at which to dig, drill or otherwise form the tunnels, the workers would either know in advance the depth of the foundation in the ground or while forming holes 60 alongside the foundation the workers would ascertain the foundation's depth.

The lower end of strut 31 is attached to one end of chain connector 33. The other connector end would be removably linked or hooked to rod or pin 42. Thus the chain connector may extend between strut 31 and pin 42, via the mentioned tunnel 70 underneath the foundation 11. Said pin 42 may be fixedly or removably secured to the foundation by being inserted or driven into aperture 41, formed therein. The chain would be cinched, or tightened, prior to activating the jack. Such tightening may be accomplished by first pulling upwardly on its end away from its linkage with strut 31, and then, while keeping the connector taut, attaching a link thereof to the adjacent pin 42.

A combination force distributing and friction reducing metal rod, or roller, 50 is movably positioned intermediate strut 31 and the wall or the wall's foundation. Normally said roller is positioned adjacent the foundation and all forces are exerted directly against the foundation. In some limited circumstances, such as when the wall and foundation may be unitary, the forces generated may be directed against the wall itself.

Consider now the operation of the device and method. With the combination force distributing and friction reducing roller 50, and angle member 30, positioned as indicated, and with pin 42 inserted within aperture 41, and with jack 40 resting on the ground or on a platform provided so that the jack's lift member 61 is positioned so as to urge cross piece 32 upwardly, and with the connector 33 linked to pin 42 and to the lower end of strut 31, the device is ready for operation.

Jack 40 is activated so that lift member 61 exerts an upwardly force against cross piece 32. This lifts the entire angle member 30 upwardly until connector 33 is stretched taut, by virtue of it being hooked to pin 42, which, in turn is inserted within aperture 41. After the connector is stretched taut, any further force exerted by lift member 61 against cross piece 32 results in strut 31 pivoting about roller

50, causing a force component in the direction of the arrow "A". Likewise an oppositely directed component force in the direction of arrow "A" is exerted against foundation 11, by virtue of the lower strut end moving to the right of the drawing, and its linkage to connector 33. These oppositely directed forces tend to rotate the wall and foundation in a counterclockwise direction from the position shown in the drawing. The effect is to retilt the wall toward its initial upright position.

This process may be contemporaneously utilized in several spaced positions extending along the wall, with each position having a hole 60 on each side of the wall, connected by a tunnel 70, with the previously described jack, angle member, roller, and connector combination for each position. After each spaced jack has been operated at such a position, a certain number of jacks, preferably alternate ones, with their related materials (angle members, connectors and pins) would be removed for subsequent use. Additional supporting material, such as concrete and reinforcing material, then may be used to fill such position's holes 60 and connecting tunnels 70. After such supporting material hardens, approximately 24 hours, the remaining units comprised of jacks, angle members and connectors may normally be removed and repositioned further down the wall, and their holes 60 and tunnels 70 cemented into supporting relation against the foundation. Thereafter, the entire cycle may be repeated along the length of the wall.

Although only a single embodiment has been described, it should be obvious that numerous modifications would be possible by one skilled in the art without departing from the spirit of the invention, the scope of which is limited only by the following claims.

I claim:

1. A method of straightening a wall positioned on a foundation comprising the steps of:

at least partially encircling said foundation with a connector;

securing one end of said connector to one of said foundation and said wall;

securing the other end of said connector to a force translation device;

translating a component of a force, generated by a jack, in one direction against said force translation device, into another force exerted by said translation device against one of said foundation and wall; and jointly reducing friction and distributing the force between said force translation device and one of said foundation and wall.

2. A wall straightening device for straightening a tilting wall which wall is supported by a foundation, said device comprising:

connector means adapted to extend under, and at least partially encircle said foundation, said connector means adapted to be secured at one end to one of said wall and foundation and at the other end to converting means;

said converting means includes a strut secured to said other end of said connector means and having a cross piece depending approximately perpendicularly from said strut;

said converting means comprising means adapted to convert a vertical component of a force, which force is exerted against said cross piece by a jack, in a first direction approximately parallel to said wall prior to tilting to a force exerted against one of said wall and foundation in a second direction approximately normal to said wall after tilting.

3. A wall straightening device for straightening a wall which is supported by a foundation, said device comprising:

connector means adapted to at least partially encircle said foundation;

converting means adapted to exert a force against one of said wall and foundation, said converting means including a linearly extending strut member, a cross member engageable with a jack, said cross member angularly depending from said strut, and also including roller means adapted to be positioned intermediate said strut and at least one of said foundation and wall;

wherein said connector means is adapted to be linked to said wall and to said converting means such that a component of said force from said jack acting upon said converting means is converted to a force acting upon one of said foundation and wall.

4. The device of claim 3 wherein said connector means comprises a chain member adapted to be secured to a pin member opposite said converting means, said pin member being adapted to be secured to one of said foundation and wall.

5. A wall straightening device for straightening a wall supported by a foundation, said device comprising:

securing means adapted to secure one end of connector means to one of said foundation and wall, said securing means including pin means adapted to be inserted within aperture means provided in one of said foundation and wall;

converting means adapted to convert at least a component of a first force generated by a jack in a direction substantially parallel to said wall into a second force exerted in a direction substantially normal to said wall, said converting means including an angle member having a linearly extending strut and a cross piece; wherein said connector means is linked to both said pin means and to said strut.

6. The device of claim 5 wherein said device includes roller means adapted to be positioned intermediate said strut and one of said foundation and wall.

* * * * *